United States Patent [19]

Brill

[11] Patent Number: 4,907,374

[45] Date of Patent: Mar. 13, 1990

[54] WHEELHEAD FOR GRINDING MACHINES

[75] Inventor: Jürgen Brill, Stuttgart, Fed. Rep. of Germany

[73] Assignee: Schaudt Maschinenbau GmbH, Stuttgart, Fed. Rep. of Germany

[21] Appl. No.: 223,780

[22] Filed: Jul. 22, 1988

[30] Foreign Application Priority Data

Jul. 25, 1987 [DE] Fed. Rep. of Germany ..... 3724698

[51] Int. Cl.[4] ..... B24B 41/00

[52] U.S. Cl. ..... 51/168; 409/231

[58] Field of Search ..... 51/168, 166 MH, 166 TS; 409/230, 231, 232, 233, 234

[56] References Cited

U.S. PATENT DOCUMENTS 4,009,637 3/1977 Bittney ..... 51/168

FOREIGN PATENT DOCUMENTS 81647 1/1957 Denmark ..... 51/168
3533090 3/1987 Fed. Rep. of Germany ..... 51/168
199356 9/1987 Japan ..... 51/168
398519 9/1933 United Kingdom ..... 5/168

*Primary Examiner*—Roscoe V. Parker
*Attorney, Agent, or Firm*—Peter K. Kontler

[57] ABSTRACT

A wheelhead for use in grinding and like machines has a spindle which is rotatably mounted in a bearing and supports at least two grinding wheels one of which is attached to the spindle for treatment of two or more successive workpieces, particularly for finish grinding camshafts, cylinders, rolls and like objects. Another grinding wheel is separably coupled to the spindle so that it can be detached upon completed preliminary treatment of each of a series of successive workpieces. The separable grinding wheel is outwardly adjacent the one grinding wheel and is coupled to the spindle by manually operable means or by means which facilitates automatic mounting of such wheel on and automatic detachment of such wheel from the spindle by a wheel changer. The wheelhead can be used with advantage in universal or special external cylindrical grinding machines.

10 Claims, 2 Drawing Sheets

WHEELHEAD FOR GRINDING MACHINES

CROSS-REFERENCE TO RELATED CASE

The wheelhead of the present invention can be used in machine tools of the type disclosed in the commonly owned copending patent application Ser. No. 223,427 filed July 22, 1988 for "Method of and apparatus for changing material removing wheels in machine tools".

BACKGROUND OF THE INVENTION

The invention relates to machine tools in general, and more particularly to improvements in grinding and like machines which employ material removing wheels. Still more particularly, the invention relates to improvements in so-called wheelheads which can be used in universal or special grinding and like machines to treat workpieces by means of several material removing wheels.

It is often desirable and advantageous to treat each of a series of successive workpieces by two or more grinding wheels, for example, to carry out a preliminary grinding operation with a coarse-grained grinding wheel and to complete the grinding operation (i.e., to carry out the so-called finish grinding) with a fine-grained grinding wheel. In order to save time and to reduce the down times of the machine, it is desirable to complete a multi-stage grinding operation without detaching the workpiece from its support, e.g., without removing the workpiece from the space between the centers of a headstock and a tailstock. Heretofore known proposals to accomplish such objects include the utilization of wheelhead with a single spindle and with means for separably mounting on the spindle any one of a plurality of different grinding wheels so that a wheel for coarse grinding must be removed upon completion of a preliminary grinding operation in order to provide room for a different wheel which is designed for finish grinding. A drawback of this proposal is that the treatment of each and every workpiece (which must be subjected to a series of different treatments involving the use of different grinding wheels) necessitates at least two exchanges of grinding wheels with attendant long intervals of idleness of the machine. Furthermore, each exchange of grinding wheels invariably involves some radial deviation of the mounted grinding wheel (i.e., the freshly mounted grinding wheel runs out of true) so that, if a workpiece is to be ground with a high or reasonably high degree of precision, it is necessary to dress each and every freshly mounted grinding wheel before the freshly mounted grinding wheel comes in contact with a workpiece.

In accordance with another prior proposal, the wheelhead is provided with two spindles each of which can carry a single grinding wheel. The wheelhead can be indexed between two positions in one of which the wheel on one of the spindles is ready to remove material from a workpiece and in the other of which the wheel on the other spindle can be caused to contact a properly mounted workpiece. Such proposal is quite satisfactory except that the cost of a wheelhead with two spindles is quite high and the wheelhead with two spindles takes up a substantial amount of space.

In accordance with a further proposal, the grinding machine is equipped with two wheelheads each of which carries a single spindle for a single grinding wheel. This solution also exhibits the drawback that the two wheelheads occupy too much space and contribute significantly to the initial and maintenance cost of the machine.

OBJECTS OF THE INVENTION

An object of the invention is to provide a novel and improved wheelhead for use in grinding and like machines which can support a plurality of material removing wheels in such a way that the treatment of successive workpieces by several material removing wheels takes up less time than with conventional wheelheads.

Another object of the invention is to provide a novel and improved combination of material removing wheels for use with the above outlined wheelhead.

A further object of the invention is to provide a grinding or like machine which embodies the above outlined wheelhead.

An additional object of the invention is to provide a novel and improved method of shortening the intervals of idleness of a grinding machine employing a wheelhead for several grinding wheels.

An additional object of the invention is to provide a wheelhead which can be utilized in different types of grinding machines including all kinds of external cylindrical grinding machines.

Still another object of the invention is to provide a wheelhead with a plurality of grinding wheels which can be used for removal of material from a wide variety of workpieces in a time-saving manner.

A further object of the invention is to provide a wheelhead which exhibits the above outlined advantages and wherein the material removing wheels can be mounted or from which the material removing wheels can be detached manually or by an automatic wheel changer.

Another object of the invention is to provide a wheelhead whose material removing wheels can be used to carry out identical or different grinding, polishing or like operations.

An additional object of the invention is to provide a wheelhead which embodies the above outlined features and can be used in available grinding or like machines.

SUMMARY OF THE INVENTION

The invention is embodied in a wheelhead for use in grinding and like machines. The improved wheelhead comprises a rotary spindle, a bearing or carrier for the spindle, a plurality of material removing wheels which are coaxial with the spindle, and means for securing the wheels to the spindle. The securing means includes means for separably coupling at least one of the wheels to the spindle so that the one wheel can be mounted on and detached from the spindle.

The wheels preferably include a second wheel which is closely (e.g., immediately) adjacent the one wheel, and the securing means of such wheelhead can comprise means for substantially permanently attaching the second wheel to the spindle.

The aforementioned coupling means preferably includes means for clamping the one wheel to the spindle. In accordance with one presently preferred embodiment of the wheelhead, the coupling means comprises manually operable means for separably securing the one wheel to the spindle. Alternatively, the coupling means can comprise means for facilitating automatic mounting of the one wheel on and automatic detachment of the one wheel from the spindle by a suitable wheel changer. Such facilitating means can include a male coupling element on the spindle and a female coupling element on the one wheel. If the spindle is hollow, the male coupling element is preferably installed in the interior of such hollow spindle and can comprise claws which are engageable with the female coupling element of the one wheel.

It is preferred to select the wheels in such a way that the one wheel and the second wheel can carry out different operations on each of a series of successively treated workpieces, e.g., shafts, camshafts, rolls and the like. For example, the one wheel can constitute a coarse-grained grinding wheel which serves to carry out preliminary grinding operations preparatory to treatent of workpieces by the second wheel. The second wheel can constitute a fine-grained grinding wheel which serves to carry out finish-grinding operations.

When supplied to a shop or factory, the wheelhead comprises a rotary spindle, a bearing or carrier for the spindle, and means for securing a plurality of material removing wheels (such as grinding wheels) to the spindle. The securing means includes means for substantially permanently affixing a first wheel to the spindle and means for separably coupling a second wheel to the spindle so that the second wheel can be repeatedly mounted on and detached from the spindle. As stated above, the coupling means can comprise manually operable means for separably securing a wheel to the spindle. Alternatively, the coupling means can include means for facilitating automatic mounting of the second wheel on and automatic detachment of the second wheel from the spindle.

The novel features which are considered as characteristic of the invention are set forth in particular in the appended claims. The improved wheelhead itself, however, both as to its construction and its mode of operation, together with additional features and advantages thereof, will be best understood upon perusal of the following detailed description of certain specifc embodiments with reference to the accompanying drawing.

DESCRIPTION OF PREFERRED EMBODIMENTS

Figure 1:
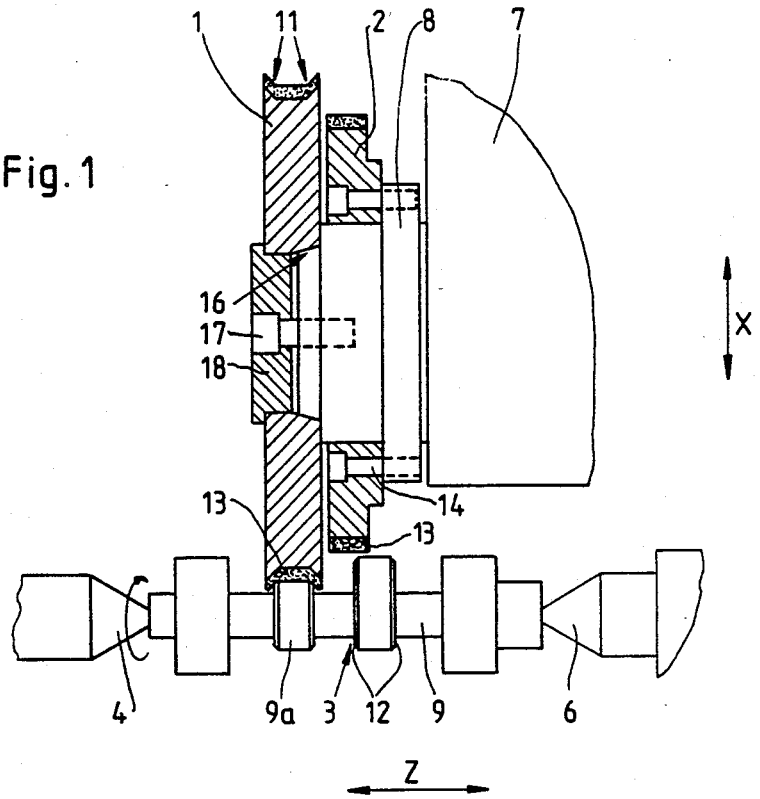
FIG. 1 is a fragmentary partly elevational and partly axial sectional view of a wheelhead which embodies one form of the invention, the removable grinding wheel being shown in the process of treating a cam of a camshaft.

Referring first to FIG. 1, there is shown a portion of a grinding machine which is designed for grinding of workpieces 3 in the form of camshafts 9. The camshaft 9 which is shown in FIG. 1 has a plurality of cams *9a* which are spaced apart from each other in the axial direction of the workpiece. The workpiece 3 (i.e., the camshaft 9) is held between the center 4 of a conventional headstock and the center 6 of a conventional tailstock. The machine in which the structure of FIG. 1 is installed can be of the type known as C501/502 which is manufactured and sold by the assignee of the present application. Save for the improved wheelhead, the machine can be identical with a conventional camshaft grinding machine.

The workpiece 3 is driven by the center 4 of the headstock in the conventional way. The headstock and the tailstock are mounted on a carriage (not shown) which is reciprocable in directions indicated by a double-headed arrow Z so as to properly locate a selected portion (cam *9a*) at the grinding station. Each cam *9a* is to be treated by several grinding wheels including a removable or detachable grinding wheel 1 and a more permanently installed grinding wheel 2. The grinding wheels can be moved radially of the properly installed workpiece 3 in directions which are indicated by a double-headed arrow X. The wheels 1 and 2 are mounted for rotation on the tool spindle 8 of the improved wheelhead, and such spindle is rotatable in a carrier or bearing 7. The motor which drives the spindle 8 is not shown in the drawing.

The removable or readily exchangeable grinding wheel 1 is designed for preliminary or coarse grinding of cams *9a*, and more or less permanently installed grinding wheel 2 is designed for finish grinding of the cams. In other words, a preliminary treatment of each cam *9a* with the working surface of the grinding wheel 1 is followed by a treatment with the working surface of the grinding wheel 2. The material 13 of the removable grinding wheel 1 is coarse grained in contrast to the fine-grained material 13 of the grinding wheel 2. The arrangement is normally such that successive cams *9a* of the workpiece 3 between the centers 4 and 6 are treated first by the profiled working surface 11 of the grinding wheel 1, and such preliminary treatment is followed by a final treatment with the grinding wheel 2. The profiled working surface 11 of the grinding wheel 1 removes the major part of material which is to be removed from successive cams *9a* so that a relatively small quantity of additional material must be removed as a result of treatment of cams *9a* by the working surface of the grinding wheel 2. The profiled working surface 11 of the grinding wheel 1 is designed to remove material from the edges 12 of successive cams *9a* of the workpiece 3 between the centers 4 and 6.

The grinding wheel 1 is detached from the spindle 8 upon completion of preliminary grinding of all cams *9a* between the centers 4 and 6. This enables the wheelhead including the bearing or carrier 7, spindle 8 and grinding wheel 2 to move in the direction of the arrow X so as to place the working surface of the grinding wheel 2 into material removing contact with the peripheral surfaces of successive cams *9a*.

The means for substantially permanently affixing the grinding wheel 2 to the spindle 8 includes screws, bolts or analogous connecting elements 14. Such elements have threaded shanks which extend into complementary taped bores in a collar of the spindle 8. It is clear that the permanent connection between the grinding wheel 2 and the spindle 8 is maintained only as long as the grinding wheel 2 is still capable of being put to use. In other words, the term "permanent connection" is intended to denote that the grinding wheel 2 need not be removed from the spindle 8 upon completion of treatment of each of a series of succesive workpieces 3. The number of workpieces which can be treated with one and the same grinding wheel 2 will depend on several parameters, such as the amount of material which must be removed from the cams 9*a* per workpiece 3, the dimensions of the grinding wheel 2, the hardness of the material adjacent the working surface of the grinding wheel 2, and others.

An advantage of the more or less permanently installed grinding wheel 2 is that such grinding wheel is highly unlikely to run out of true upon completion of each grinding operation because it need not be detached from the spindle 8 until and unless it is used up to such an extent that it is incapable of being put to further use. In other words, if the grinding wheel 2 is dressed immediately after attachment to the spindle 8 (the dressing tool is not shown in the drawing), it continues to operate properly (without radial deviations) as long as it remains attached to the spindle.

Eventual or potential running of the removable grinding wheel 1 out of true (because it must be repeatedly attached to and detached from the spindle 8) is not detrimental to the quality of treatment of succesive workpieces 3 because the grinding wheel 1 is designed to carry out a preliminary or coarse treatment of cams 9*a*. Therefore, eventual minor radial deviations of the repeatedly detached and reattached grinding wheel 1 do not appreciably affect the quality of overall treatment of successive workpieces 3.

The grinding wheel 1 is reattached to the spindle 8 as soon as the finish grinding of cams 9*a* on the workpiece 3 between the centers 4 and 6 is completed.

In FIG. 1, the means for coupling the grinding wheel 1 to the spindle 8 outwardly adjacent and close to the grinding wheel 2 is operable by hand so that the improved wheel head can be installed in grinding machines which do not embody or do not cooperate with automatic wheel changers. The illustrated coupling means comprises a tensioning screw 17 which is coaxial with and is driven into the front end face of the spindle 8 so as to urge a conical internal surface 16 of the grinding wheel 1 into engagement with the complementary conical external surface of a short cone at the front end of the spindle 8. A ring- or disc-shaped insert 18 of the coupling means is provided to close the central opening of the removable grinding wheel 1 and to urge such grinding wheel against the cone of the spindle 8 when the tensioning screw 17 is properly affixed to the spindle.

The aforementioned reference characters 13 denote the hard or extremely hard grains of material of the grinding wheels 1 and 2. For example, each of the grinding wheels 1 and 2 can constitute a CBN-wheel. Such grinding wheels exhibit a pronounced hardness so that they need not be replaced at frequent intervals.

Figure 2:
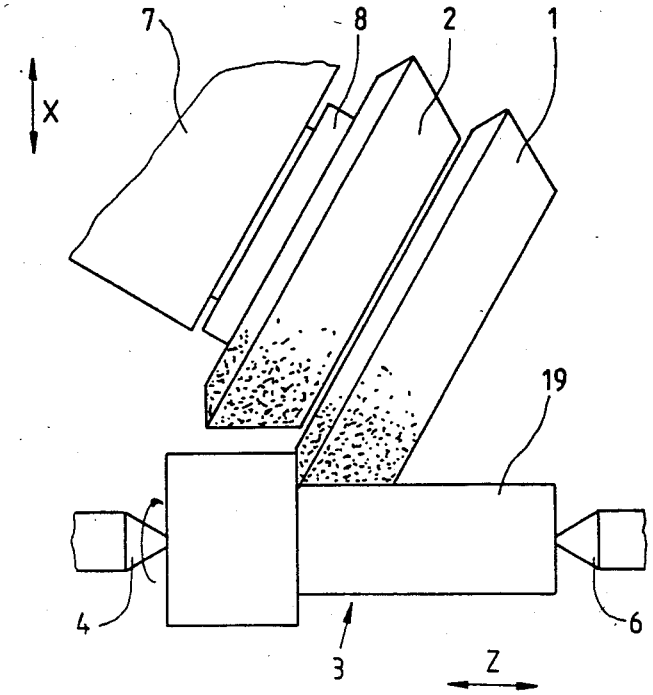
FIG. 2 is a fragmentary elevational view of a modified wheelhead, the removable grinding wheel being in the process of removing material from a different workpiece.

FIG. 2 shows a portion of a modified wheelhead wherein the axis of the spindle 8 in the bearing or carrier 7 is inclined with reference to the axis of the workpiece 3 between the centers 4 and 6. The workpiece 3 includes a shaft 19 which has a smaller-diameter cylindrical portion and a larger-diameter cylindrical portion. The profiles of the removable grinding wheel 1 and of the permanently installed grinding wheel 2 are designed to ensure that such grinding wheels can properly treat the annual shoulder between the two cylindrical portions of the workpiece 3.

Figure 3:
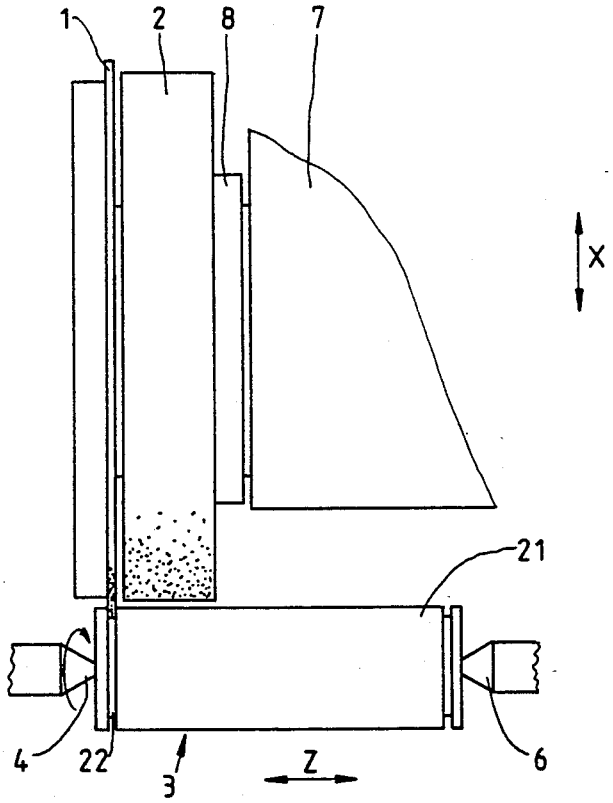
FIG. 3 is a fragmentary elevational view of a third wheelhead with a thin disc-shaped removable grinding wheel in the process of grinding a groove in the peripheral surface of a cylindrical workpiece.

FIG. 3 shows a portion of a further wheelhead with a spindle 8 in a carrier or bearing 7, a more or less permanently installed cylindrical grinding wheel 1, and a narrow disc-shaped removable grinding wheel 1 which is located in front of and is closely adjacent the grinding wheel 2. The purpose of the grinding wheel 1 is to grind circumferentially complete grooves 22 in selected portions of the peripheral surface of a workpiece 3 which includes an elongated cylindrical bolt 21. The end portions of the workpiece 3 are held between the center 4 of the headstock and the center 6 of the tailstock in an external cylindrical grinding machine which employs the improved wheelhead.

The mode of operation of a machine with the wheelhead of FIG. 2 or 3 is the same as that of a machine with the wheelhead of FIG. 1. Thus, the grinding wheel 1 of FIG. 2 or 3 is removed upon completion of the corresponding grinding operation so as to enable the permanently installed grinding wheel 2 to perform a finish grinding operation upon the respective workpiece 3.

Figure 4:
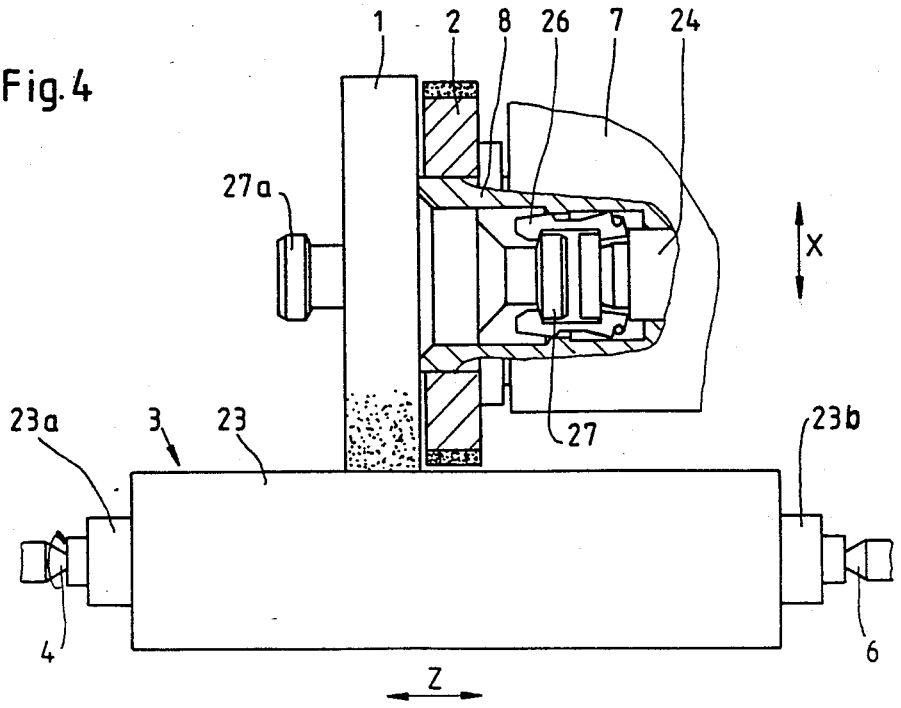
FIG. 4 is a fragmentary partly elevational and partly axial sectional view of a fourth wheelhead wherein the removable grinding wheel is coupled to the spindle by means which facilitates automatic mounting and automatic detachement of such grinding wheel by the wheel changer of a grinding machine.

FIG. 4 shows a modified wheelhead which operates with two grinding wheels 1 and 2 capable of treating a workpiece 3 in the form of a roll 23 with coaxial stubs 23*a* and 23*b*. The stubs are held between the center 4 of the headstock and the center 6 of the tailstock of the grinding machine in which the wheelhead of FIG. 4 is put to use. The removable grinding wheel 1 can be used for preliminary grinding of the roll 23 and of the right-hand stub 23*b*. However the grinding wheel 2 is preferably used for preliminary as well as finish grinding of the left-hand stub 23*a* because the wheel 1 would be incapable of carrying out a preliminary grinding of the stub 23*a*.

The means for coupling the removable grinding wheel 1 to the spindle 8 of the wheelhead which is shown in FIG. 4 is designed to facilitate automatic mounting of the grinding wheel 1 on and automatic detachment of this grinding wheel from the spindle 8. Such automatic mounting and detachment can be carried out by a conventional wheel changer which can engage a suitably configurated coaxial extension or anchor 27*a* at the outer side of the hub of the wheel 1. The means for facilitating automatic mounting includes a female coupling element 24 which is installed in the interior of the hollow spindle 8 and has claws 26 serving to engage a male coupling element 27 which is provided on the removable grinding wheel 1. The means for tensioning the coupling between the grinding wheel 1 and the spindle 8 is not specifically shown in the drawing. Such tensioning means includes means for pulling the coupling element 24 and its claws 26 in a direction to the right. The pulling means can include conventional mechanical pulling elements which are not shown in FIG. 4. Loosening of the coupling between the grinding wheel 1 and the spindle 8 of FIG. 4 is initiated by the hydraulic system of the grinding machine in which the wheelhead of FIG. 4 is put to use. The coupling means of FIG. 4 can be similar to or identical with those known as Ott tool clamping devices manufactured and sold by the West German Firm A. Ott Spanntechnik. As mentioned above, once the coupling including the coupling elements 24, 27 is loosened, a conventional wheel changer can engage the anchor 27*a* to remove the grinding wheel 1 from the spindle 8 so that the grinding wheel 2 can carry out the finish grinding of the roll 23 and stub 23*b* as well as a preliminary and finish grinding of the stub 23*a*.

The improved wheelhead can be used with advantage in many types of grinding machines. Furthermore, the workpiece 3 which are shown in FIGS. 1–4 are but a few examples of workpieces which can be treated with the improved wheelhead. Still further, the wheelhead can carry three or more grinding wheels without departing from the spirit of the invention. For example, the wheelhead can be provided with means for separably securing to the spindle 8 at least two removable grinding wheels and for more or less permanently mounting one or two additional grinding wheels. Still further, the securing means which are shown in FIGS. 1 and 4 are only two examples of numerous means which can be employed to secure two or more grinding wheels to the spindle 8. All embodiments of the invention exhibit the advantage that the workpiece 3 can remain between the centers of the headstock and the tailstock irrespective of the number of treatments to which its parts are to be subjected. All that is necessary is to temporarily remove at least one grinding wheel prior to completion of the grinding operation upon a workpiece which is located at the grinding station.

The removable grinding wheel 1 must be detached from the respective spindle 8 during a particular stage of a grinding operation which depends upon the nature of the workpiece and/or upon the nature of treatment.

The improved wheelhead exhibits a number of important advantages. Thus, it is not necessary to frequently dress the more or less permanently installed grinding wheel or grinding wheels because such grinding wheel or wheels are not detached upon completion of treatment of each of a series of successively treated workpieces. Moreover, and as already pointed out above, eventual minor radial deviations of the removable grinding wheel or wheels do not appreciably affect the quality of the grinding operation because such grinding wheel or wheels are normally or frequently used solely to carry out preliminary grinding operations.

Another important advantage of the improved wheelhead is its versatility. Such wheelhead can be used in external circular grinding machines, in grinding machines for camshafts, in flat surface grinding machines and in many other machine tools wherein the treatment of workpieces necessitates or renders advisable the utilization of two or more grinding wheels.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A wheelhead for use in grinding and like machines, comprising a rotary spindle; a plurality of material removing wheels coaxial with said spindle; and means for securing said wheels to said spindle, said securing means including means for separably coupling at least one of said wheels to said spindle so that said one wheel can be repeatedly mounted on and detached from the spindle, said coupling means including means for facilitating automatic mounting of said one wheel on and automatic detachment of said one wheel from said spindle.

2. The wheelhead of claim 1, wherein said wheels include a second wheel which is closely adjacent said one wheel, said securing means further comprising means for substantially permanently attaching said second wheel to said spindle.

3. The wheelhead of claim 1, wherein said coupling means includes means for clamping said one wheel to said spindle.

4. The wheelhead of claim 1, wherein said facilitating means includes a male coupling element on one of the parts including said spindle and said one wheel, and a female coupling element on the other of said parts.

5. The wheelhead of claim 4, wherein said spindle is hollow and one of coupling elements is disposed in said spindle.

6. The wheelhead of claim 5, wherein said female coupling element comprises claws engageable with said male coupling element.

7. The wheelhead of claim 1, wherein said wheels include a second wheel, said one wheel and said second wheel being arranged to carry out different operations on each of a series of successively treated workpieces.

8. The wheelhead of claim 7, wherein said one wheel is a coarse-grained grinding wheel arranged to carry out preliminary grinding operations preparatory to treatment of workpieces by said second wheel.

9. The wheelhead of claim 7, wherein said second wheel is a fine-grained grinding wheel arranged to carry out finish grinding operations.

10. A wheelhead for use in grinding and like machines, comprising a rotary spindle; a bearing for said spindle; and means for securing a plurality of material removing wheels to said spindle, including means for substantially permanently affixing a first wheel to said spindle and means for separably coupling as second wheel to said spindle so that the second wheel can be mounted on and detached from said spindle, said couplng means including means for facilitating automatic mounting of the second wheel on and automatic detachment of the second wheel from said spindle.

* * * * *